US009693617B2

(12) United States Patent
LaTorre et al.

(10) Patent No.: US 9,693,617 B2
(45) Date of Patent: Jul. 4, 2017

(54) NAIL CLIPPING AND CUTTING DEVICE

(71) Applicants: Salvatore LaTorre, Lenox Township, MI (US); Joanne Safie, Chesterfield, MI (US)

(72) Inventors: Salvatore LaTorre, Lenox Township, MI (US); Joanne Safie, Chesterfield, MI (US)

( * ) Notice: Subject to any disclaimer, the term of this patent is extended or adjusted under 35 U.S.C. 154(b) by 25 days.

(21) Appl. No.: 14/674,287

(22) Filed: Mar. 31, 2015

(65) Prior Publication Data

US 2016/0286931 A1 Oct. 6, 2016

(51) Int. Cl.
*A45D 29/02* (2006.01)

(52) U.S. Cl.
CPC ..... *A45D 29/023* (2013.01)

(58) Field of Classification Search
CPC ..... A45D 29/023
See application file for complete search history.

(56) References Cited

U.S. PATENT DOCUMENTS 4,341,015 A * 7/1982 Young ..... A45D 29/023 132/76.2
5,490,327 A * 2/1996 Ohori ..... A45D 29/02 132/75.5
5,632,288 A * 5/1997 Webb ..... A45D 29/023 132/75.5
5,931,167 A * 8/1999 Coleman ..... A45D 26/0066 132/73
D554,289 S * 10/2007 Johnson ..... D28/60

* cited by examiner

*Primary Examiner* — Sarah McPartlin
(74) *Attorney, Agent, or Firm* — Inventa Capital PLC

(57) ABSTRACT

A nail clipping device of the present invention presents a nail clipper and a housing adaptable to fit onto the nail clipper. The housing is made of a resilient material having open scoop overhanging cutting portions of the nail clipper for receiving nail clippings. The housing is designed to allow convenient collection and disposal of the nail clippings. The housing includes a magnifying glass connected thereto for better targeting of the nails to be clipped.

13 Claims, 4 Drawing Sheets

FIG. 5
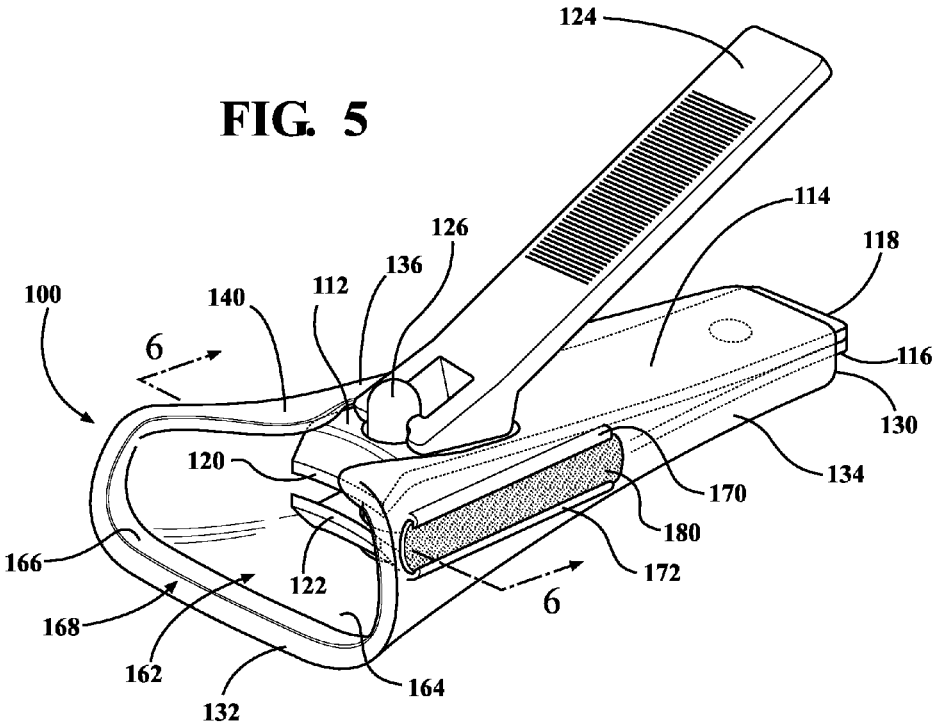
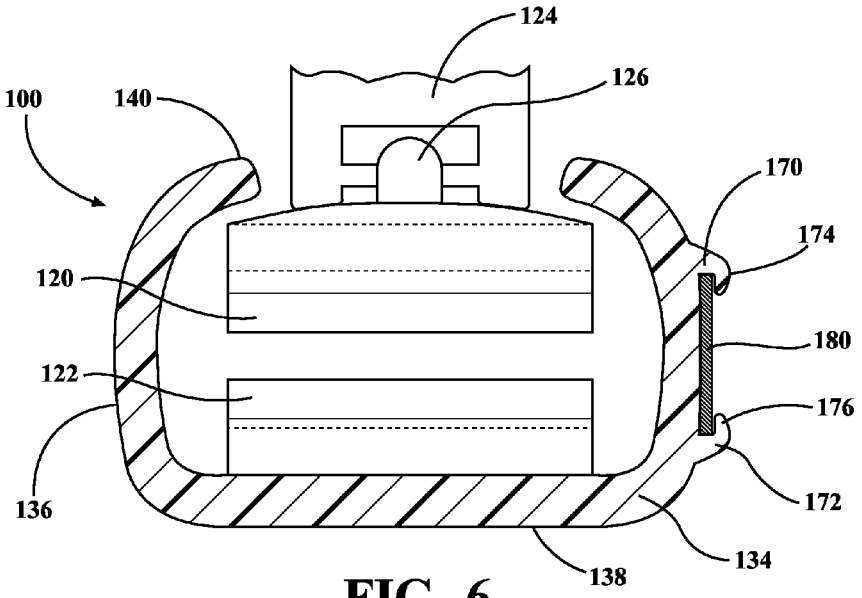
FIG. 6

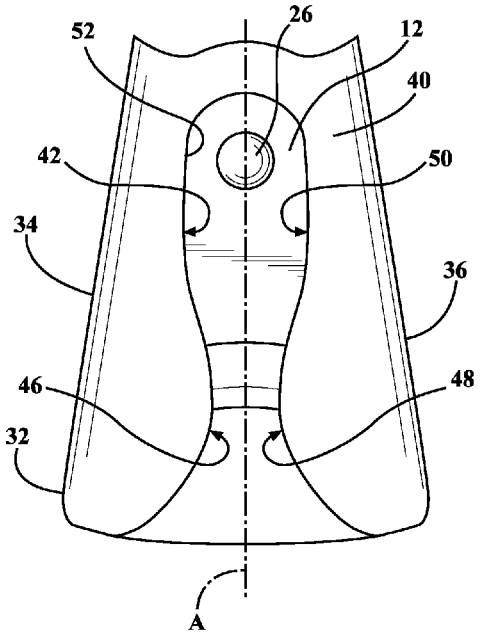
FIG. 7
FIG. 8
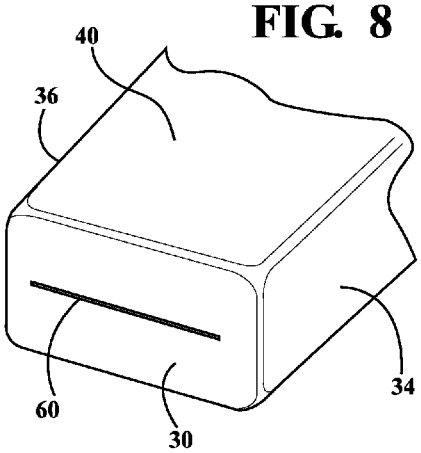
FIG. 9
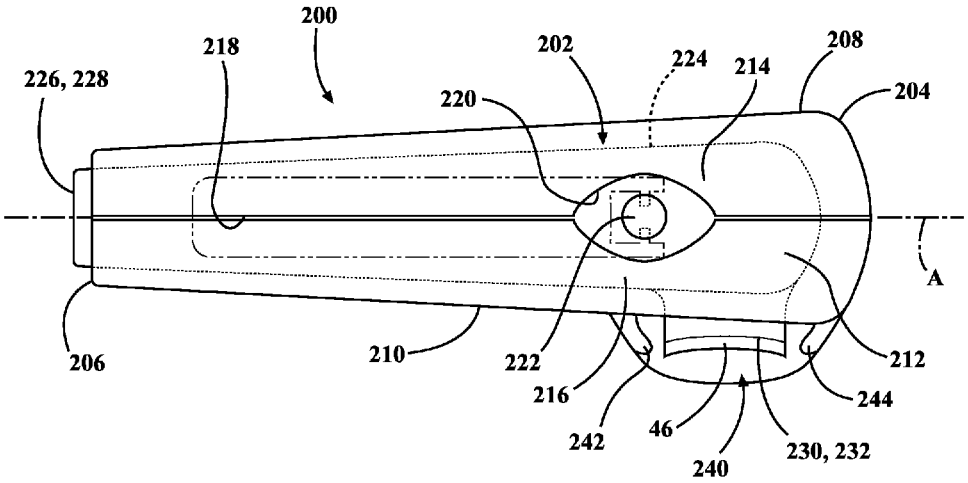

NAIL CLIPPING AND CUTTING DEVICE

RELATED APPLICATIONS

This application incorporates U.S. application Ser. No. 14/474,138, filed on Aug. 21 2014, by reference in its entirety.

FIELD OF THE INVENTION

The present invention relates to nail clipping and cutting devices and more particularly to nail clippings receptacles having enhancements that improve the receptacle's functionality.

BACKGROUND OF THE INVENTION

People of all ages trim and clip nails on daily bases. Nail clippers became a necessity as people cannot get by especially during travel. When a person trims his nails, the nail clippings have a tendency to spring away from the nail clipper in any number of unpredictably different directions. However, few people want to put up with the hassle of and spend time for searching for stray nail clippings. For this reason there is a strongly perceived need for nail clippings receptacles for use with nail clippers. Many attempts to devise such receptacles have been made over the years but resulted in numerous failings.

The art of various types of nail clippers is replete as finger and toenail clippers having means for collecting nail clippings during the clipping process are known in the art. For example, U.S. Pat. No. 3,855,698 to Crosby provided an enclosed nail clip and an enclosing case having a reservoir structure for the clipped nails. The clipping lever was enclosed but had an exposed lever-end accessible for applying finger pressure thereto to close the clipper blades. The casing structure provided a concavely-shaped aperture following the opposing blades providing access to finger ends carrying nails to be clipped. The enclosure was openable for emptying collected nail clippings.

Another prior art reference, namely U.S. Pat. No. 3,997,966 to Sertore provided a nail clipper which had upper and lower handles to facilitate holding the unit and maintaining it in the desired position. It had cutting jaws on three sides to allow nail clipping for different and more convenient angles, and a clipping-receiving receptacle with a removable lid for surrounding the unit and holding the nail clippings.

Still another prior art reference, such as U.S. Pat. No. 3,169,312 to Fink provided a nail guard for mounting on a nail clipper. The nail guard possessed sufficient flexibility so as to enable a slight outward flexing of the side panels which was sufficient to allow the positioning of the lower jaw member between the detents and the bottom panel. Means were provided for pivotally mounting the guard on the nail clipper for movement between a first position where the side panels were positioned on opposite sides of the space between the jaw members so as to enclose this space, and a second position wherein the guard was oriented below the lower jaw so as to open the space between the jaws, and providing a barrier for retaining the cut nails within the enclosed space.

Later on, another prior art reference, i.e. U.S. Pat. No. 4,602,430 to Allen disclosed a handle and clipping receptacle that provided a removable accessory for a nail clipper of the lever action type. A resilient body member defines a slot into which the clipper can be inserted and retained by a depression formed in the bottom of the slot. The clipper is retained also by flanges and cavities within the body member. Large inner cavities extend within the body member on both sides of the clipper to receive and retain clippings sheared by the clipper. Such clippings can be disposed by removing the clipper and inverting the body member. The major disadvantage of that design was location of cutting edges along with the edge of the resilient body thereby allowing most of the clipping to escape the resilient body.

Another U.S. Pat. No. 4,731,927 to Douglas B. Wilson, describes a nail clipper in which a flexible material disposed along the sides of the clipper is intended to prevent nail clippings from falling away from a nail clipper. However, the nail clippings which are kept from falling away from the nail clipper are unfortunately not ejected away from the clipper opening and into a storage receptacle. The nail clippings, accumulating at the clipper opening, therefore have the undesired effect of jamming the clipper's cutting means. This default results in mechanism failure. Furthermore, Wilson does not disclose any means for easy emptying of the nail clippings.

Still another U.S. Pat. No. 5,195,544 to Campagna teaches a hollow nail catcher case is provided herein for use with a nail clipper. The case is preferably constructed of a thin synthetic plastic material. It includes an upper roof, a lower floor and a pair of side walls, all such roof, floor and side walls being of truncated triangular shape and being joined together to provide a hollow truncated hollow pyramid for sliding over the nail clipper. The forward end of the case includes a pair of forwardly-extending, gently-inwardly-curved, flexible walls. These walls also are provided, at their forward ends with sharply inwardly angled termini, such ends also being shaped with vertically-extending, arcuately-shaped, terminal ends, and with upper and lower curved surfaces. These arms are of sufficient longitudinal length fully to enclose the sides of the nail clipper. This enables the case to be universally usable in many different kinds of nail clippers. The gripping arms extend just as far as the nail clipping jaw thereby allowing the nails being cut to escape the nail catcher case.

However, the aforementioned prior art nail clipping devices still need improvements and modifications. Therefore, an opportunity exists for an improved nail clipping device that will be easy to manufacture and use, will offer features and functions not realized by the prior art nail clipping devices, and will eliminate any disadvantages associated with the prior art nail clipping devices.

SUMMARY OF THE INVENTION

An apparatus of the present invention presents a nail clipping device. The nail clipping device includes a nail clipper and a housing adaptable to receive the nail clipper. The housing is formed from a flexible resilient material. The housing includes a tubular configuration presenting open terminal ends of different dimensions. The housing includes a central axis extending between terminal ends, side walls, a bottom wall, and a top wall. The side walls may present a planar or curved cross section.

The top wall includes a cut out configuration adaptable to receive the nail clipper. The top wall presents the cut out portion adaptable to receive the lever of the nail clipper with the cut out portion being defined by a pair of elements extending outwardly from opposite side edges of the cut out portion to the central axis for securing the nail clipper within the housing and preventing escaping of the nail clipper from the housing.

One of the side walls includes a pair of tracks extending therefrom and spaced from one another to receive a file or other element fabricated from an abrasive material in order to polish the nails. The tracks are configured in a way that the user may remove the file as needed.

In alternative embodiment of the present invention, a housing defines a central axis extending between terminal ends. The housing is also formed from a resilient material presenting a tubular configuration and having side walls diverging from one of the terminal ends to another of terminal end, a bottom wall, and a top wall. A nail clipper presents a pair of members each extending into a cutting edge with the cutting edges extending parallel to the central axis. A lever is mechanically connected to the pair of elements for flexing the members to cut and clip the nails. The top wall presents a cut out portion to receive the lever with the cut out portion. A pair of elements extend outwardly from one of the side walls for securing the nail clipper within the housing and preventing escaping of the nail clipper from the housing.

An advantage of the present invention is to provide an improved nail clipping device that is easy to manufacture and use my people of all ages.

Another advantage of the present invention is to provide an improved nail clipping device that collects all nail cuttings and prevents the same from escaping a housing of the nail clipping device.

Still another advantage of the present invention is to provide an improved nail clipping device with the housing adaptable to engage nail clippers with cutting edges located on a front of the nail clipper or on a side of the nail clipper.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

Other objects, features, and advantages of the present invention will become apparent upon consideration of the following detailed description of a preferred embodiment thereof, when taken in conjunction with the appended drawing.

BRIEF DESCRIPTION OF THE DRAWINGS

Other advantages of the present invention will be readily appreciated as the same becomes better understood by reference to the following detailed description when considered in connection with the accompanying drawings wherein:

FIG. 5 illustrates a second alternative embodiment of the nail clipping device;

FIG. 6 illustrates a cross sectional view of the nail clipping device of FIG. 5;

FIG. 7 illustrates a top wall of the housing clipping device illustrating extension elements for holding a nail clipper within the housing;

FIG. 8 illustrates a rear end of the housing presenting a slit for discarding nail clippings from the housing; and FIG. 9 illustrates a third alternative embodiment of the nail clipping device.

DESCRIPTION OF THE INVENTION

Figure 1:
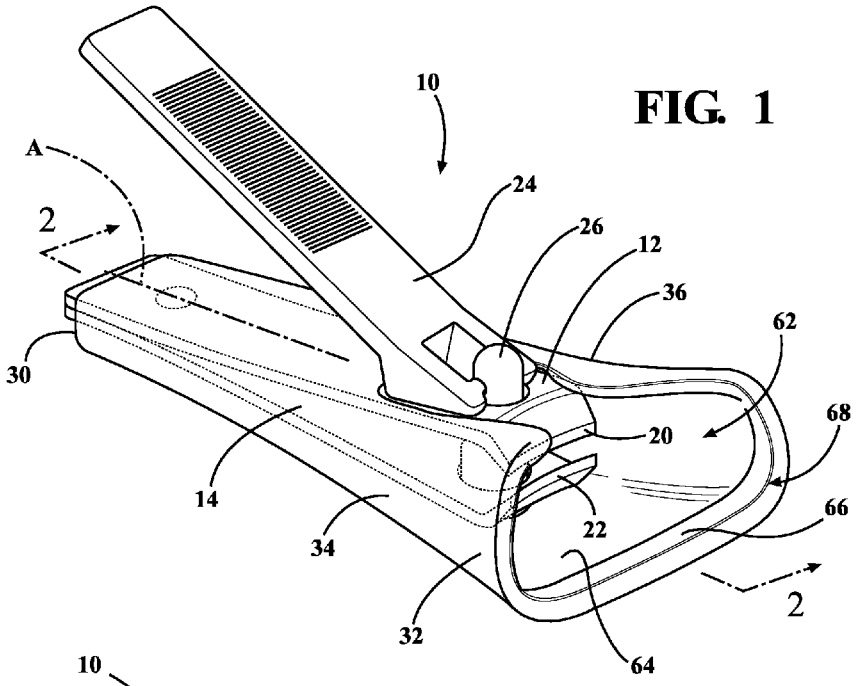
FIG. 1 illustrates a perspective view of a nail clipping device of the present invention.

Referring to FIGS. 1 through 4, 7, and 8 wherein like numerals indicate like or corresponding parts throughout the several views, an apparatus of the present invention is generally shown at 10. Referring to FIGS. 5 through 6, wherein like numerals indicate like or corresponding parts throughout the several views, a second alternative embodiment of the apparatus 10 of the present invention is generally shown at 100. Referring to FIG. 9, wherein like numerals indicate like or corresponding parts, a third alternative embodiment of the apparatus 10 of the present invention is generally shown at 200.

As shown in FIGS. 1 through 4, 7, and 8, the apparatus 10 of the present invention presents a nail clipping device. The nail clipping device 10 includes a nail clipper 12 and a housing 14 adaptable to receive the nail clipper 12. The nail clipper 12 includes a pair of members or arms 16 and 18 each presenting cutting edges 20 and 22. A lever 24 is mechanically engaged 26 with the arms 16 and 18 as known to those skilled in mechanical art to flex the arms 16 and 18 in order to clip or cut the nails. The housing 14 is formed from a flexible resilient material such as polymeric material. Other non-resilient materials may be used to form the housing 14 without limiting the scope of the present invention.

The housing 14 includes a tubular configuration presenting terminal ends of different configurations, generally indicated at 30 and 32. The housing includes side walls 34 and 36, a bottom wall 38, and a top wall 40. The side walls 34 and 36 may present a planar or curved cross section without limiting the scope of the present invention. The housing 14 defines a central axis A extending between terminal ends 30 and 32 wherein the side walls 34 and 36 diverging from one of the terminal ends 30 to another of terminal end 32. The top wall 40 includes a cut out configuration, generally indicated at 42 adaptable to receive the nail clipper 12.

The cut out portion 42 is defined by a pair of elements, generally indicated at 46 and 48 extending outwardly from opposite side edges 50 and 52 of the cut out portion 42 to the central axis A for securing the nail clipper 12 within the housing 14 and preventing escape of the nail clipper 12 from the housing 14. One of the terminal ends 30 is further defined by a rear end presenting a rectangular cross section and a slip 60 defined therein. The rear end 30 can be squeezed by the user in order to open the slit 60 and allow the nail clippings to escape the housing 14. The other of the terminal ends 32 is further defined by a nail scoop, generally indicated at 62, presenting a non-rectangular cross section. The nail scoop 62 presents a bottom portion 64 extending to a raised portion 66 defining peripheral edge, generally indicated at 68, of the nail scoop 62.

Figure 2:
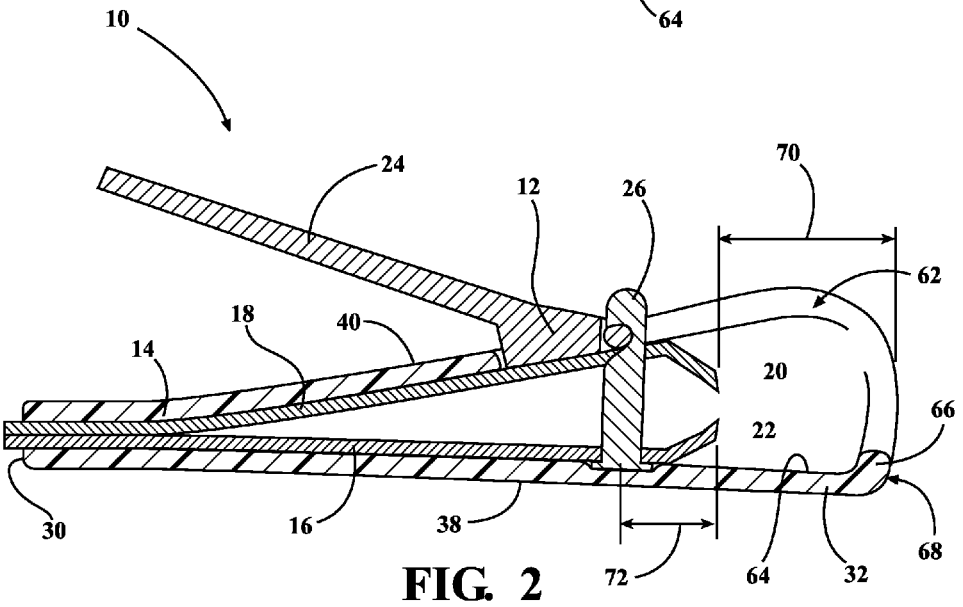
FIG. 2 illustrates a cross sectional view of the nail clipping device shown in FIG. 1.
Figure 3:
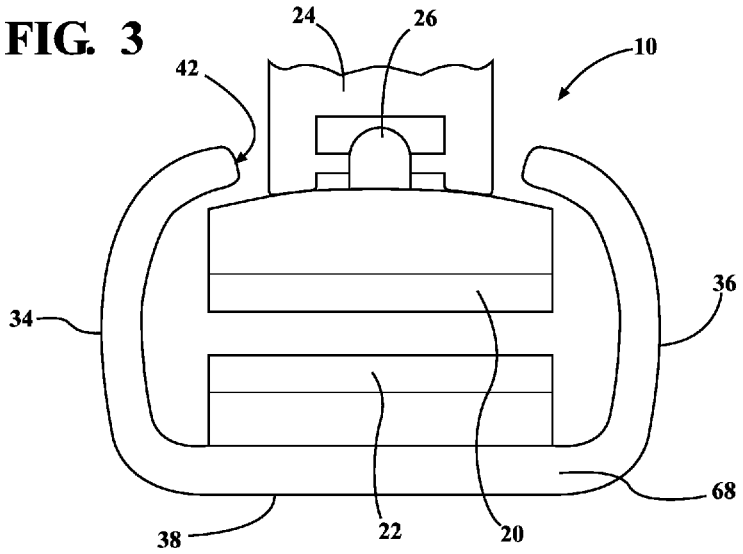
FIG. 3 illustrates a front view of the nail clipping device of FIG. 1.
Figure 4:
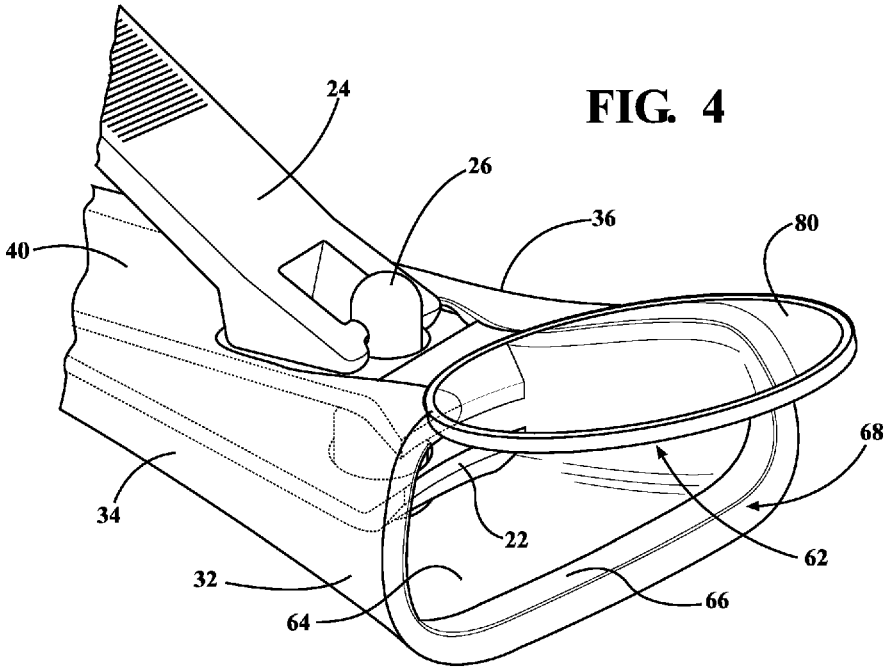
FIG. 4 illustrates an alternative embodiment of the nail clipping device.

Alluding to the above, the peripheral edge 68 of the nail scoop 62 extends beyond the cutting edges 20 and 22 to define a distance 70 between the cutting edges 20 and 22 and the peripheral edge 68. The distance 70 is at least twice longer than a distance 72 defined between the mechanical connection 26 of the lever 24 to the members 16 and 18 and the cutting edges 20 and 22 as best shown in FIG. 2. The length of the distances 70 and 72 is not intended to limit the scope of the present invention and other length may be used without limiting the scope of the present invention. As best shown in FIG. 4, the housing may also include a magnifying glass 80 connected thereto to allow for better view of the nails to be cut or clipped.

As shown in FIGS. 5 and 6, the apparatus 100 includes a nail clipper 112 and a housing 114 adaptable to receive the nail clipper 112. The nail clipper 112 includes a pair of members or arms 116 and 118 each presenting cutting edges 120 and 122. A lever 124 is mechanically engaged 126 with the arms 116 and 118 as known to those skilled in mechanical art to flex the arms 116 and 118 in order to clip or cut the nails. The housing 114 is formed from a flexible resilient material such as polymeric material. Other non-resilient materials may be used to form the housing 114 without limiting the scope of the present invention.

The housing 114 includes a tubular configuration presenting terminal ends of different configurations, generally indicated at 130 and 132. The housing includes side walls 134 and 136, a bottom wall 318, and a top wall 140. The side walls 134 and 136 may present a planar or curved cross section without limiting the scope of the present invention. The housing 114 defines a central axis A extending between terminal ends 130 and 132 wherein the side walls 134 and 136 diverging from one of the terminal ends 130 to another of terminal end 132. The top wall 140 includes a cut out configuration, generally indicated at 142 adaptable to receive the nail clipper 112.

The cut out portion 142 is defined by a pair of elements, generally indicated at 146 and 148 extending outwardly from opposite side edges 150 and 152 of the cut out portion 142 to the central axis A for securing the nail clipper 112 within the housing 114 and preventing escape of the nail clipper 112 from the housing 114. One of the terminal ends 130 is further defined by a rear end presenting a rectangular cross section and a slip defined therein. The other of the terminal ends 132 is further defined by a nail scoop, generally indicated at 162, presenting a non-rectangular cross section. The nail scoop 162 presents a bottom portion 164 extending to a raised portion 166 defining peripheral edge, generally indicated at 168.

The housing 114 includes a pair of tracks 170 and 172 each extending to hook edges 174 and 176. The tracks 170 and 172 are spaced from one another to receive a foil 180 removably connected between the tracks 170 and 172 to polish nails.

FIG. 9 illustrates a third alternative embodiment of the nail clipping device, generally shown at 200. In this alternative embodiment of the present invention, a housing, generally indicated at 202, defines a central axis A extending between terminal ends 204 and 206. The housing 202 is also formed from a resilient material presenting a tubular configuration and having side walls 208 and 210 diverging from one of the terminal end 206 to another terminal end 204. The housing 202 includes a bottom wall, and a top wall 212. The top wall 212 included two wing portions or two halves 214 and 216 spaced from one another to define a slit 218 extending along the axis A. Each wing portion 214 and 216 defines a cut out portion thereby forming an opening 220 to receive a lever 222 of a nail clipper, as shown in phantom at 224. The wing portions 214 and 216 extend outwardly from the side walls 208 and 210 for securing the nail clipper 224 within the housing 202 and preventing escaping of the nail clipper from the housing 202.

The nail clipper 224 presents a pair of members 226 and 228 as shown in phantom at 224 each extending into a cutting edge 230 and 232 with the cutting edges 230 and 232 extending parallel to the central axis A. The lever 222 is mechanically connected to the pair of elements 226 and 228 for flexing the members 226 and 228 to cut and clip the nails. One of the side walls 210 includes a scoop nail scoop, generally indicated at 240. The nail scoop 240 presents a bottom portion 246 extending to raised portion 242 and 244 for capturing the nails. The housing 202 may includes a pair of tracks (not shown) each extending to hook edges. The tracks are spaced from one another to receive a foil removably connected between the tracks to polish nails.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A device for clipping and cutting nails comprising;

a nail clipper presenting a pair of members each extending into a cutting edge and a lever mechanically connected to said pair of members for flexing said members to cut and clip nails, a housing defining a central axis extending between terminal ends and formed from a resilient material presenting a tubular configuration and having side walls diverging from one of said terminal ends to another of said terminal ends, a bottom wall, and a top wall;

wherein one of said terminal ends is further defined by a rear end presenting a rectangular cross section and a slit defined therein and another of said terminal ends is further defined by a nail scoop presenting a non-rectangular cross section; and said top wall presenting a cut out portion to receive said lever with said cut out portion defined by a pair of elements extending outwardly from opposite side edges of said cut out portion to said central axis for securing said nail clipper within said housing and preventing escaping of said nail clipper from said housing.

2. A device as set forth in claim 1, wherein said nail scoop presents a bottom extending to a raised portion defining peripheral edge of said nail scoop.

3. A device as set forth in claim 2, wherein said peripheral edge of said nail scoop configured to extend beyond said cutting edges to define a distance between said cutting edges and said peripheral edge.

4. A device as set forth in claim 3, wherein one of said side wall includes a pair of tracks extending to hook edge with said tracks being spaced from one another to receive a file removably connected therebetween to polish nails.

5. A device as set forth in claim 1, wherein said top wall and said bottom wall diverge from one another as viewed in cross section.

6. A device as set forth in claim 1, including a magnifying glass connected to said housing.

7. A device as set forth in claim 1, wherein said resilient material is a polymeric material.

8. A device for clipping and cutting nails comprising;

a housing defining a central axis extending between terminal ends and formed from a resilient material presenting a tubular configuration and having side walls diverging from one of said terminal ends to another of said terminal ends, and a bottom wall wherein one of said terminal ends is further defined by a rear end presenting a rectangular cross section and a slit defined therein;

a nail clipper presenting a pair of members each extending into a cutting edge with said cutting edges extending parallel to said central axis and a lever mechanically connected to said pair of elements for flexing said members to cut and clip the nails, and a pair of flexible portions spaced from one another and extending outwardly from said side walls for securing said nail clipper within said housing and preventing escaping of said nail clipper from said housing, said flexible portions defining a cut out portion therebetween to receive said lever.

9. A device as set forth in claim 8, wherein a nail scoop presents a bottom extending to a raised portion defining peripheral edge of said nail scoop.

10. A device as set forth in claim 8, wherein said peripheral edge of said nail scoop extends beyond said cutting edges to define a distance between said cutting edges and said peripheral edge.

11. A device as set forth in claim 8, wherein said top wall and said bottom wall diverge from one another as viewed in cross section.

12. A device as set forth in claim 8, wherein said resilient material is a polymeric material.

13. A device as set forth in claim 8, wherein one of said side walls includes a scoop nail scoop presents a bottom portion extending to raised portions for capturing the nails.

* * * * *